US007832044B2

(12) United States Patent
Kessler et al.

(10) Patent No.: US 7,832,044 B2
(45) Date of Patent: Nov. 16, 2010

(54) FLOOR MAT WITH SCRAPING AND WIPING CHARACTERISTICS

(75) Inventors: Ronald N. Kessler, Girard, OH (US); Daniel A. Kessler, Girard, OH (US)

(73) Assignee: R & L Marketing & Sales, Inc., Youngstown, OH (US)

( * ) Notice: Subject to any disclaimer, the term of this patent is extended or adjusted under 35 U.S.C. 154(b) by 1243 days.

(21) Appl. No.: 11/388,797

(22) Filed: Mar. 24, 2006

(65) Prior Publication Data

US 2006/0213019 A1 Sep. 28, 2006

Related U.S. Application Data

(60) Provisional application No. 60/665,005, filed on Mar. 24, 2005.

(51) Int. Cl.
*A47L 23/26* (2006.01)

(52) U.S. Cl. ..... 15/216; 15/217

(58) Field of Classification Search ..... 15/215, 15/216, 217, 227

See application file for complete search history.

(56) References Cited

U.S. PATENT DOCUMENTS

| | | | | |
|---|---|---|---|---|
| 4,029,834 | A * | 6/1977 | Bartlett | 428/62 |
| 5,529,825 | A * | 6/1996 | Sutherland | 428/88 |
| 5,556,685 | A | 9/1996 | Swicegood, Jr. | |
| 5,763,039 | A * | 6/1998 | Staubs | 428/95 |
| 5,881,427 | A | 3/1999 | Offner | |
| 5,962,350 | A | 10/1999 | Krotine | |
| 6,127,015 | A | 10/2000 | Kessler | |
| 6,589,631 | B1 * | 7/2003 | Suzuki et al. | 428/172 |
| 6,635,331 | B2 * | 10/2003 | Kessler | 428/100 |

* cited by examiner

*Primary Examiner*—Randall Chin
(74) *Attorney, Agent, or Firm*—Sand & Sebolt

(57) ABSTRACT

A floor mat having a base that includes a plurality of alternating fibrous strips and impervious strips and surrounded by a frame. The base is substantially continuous across its entire width and length, having no openings from its upper surface through to its lower surface. The impervious strips include a plurality of spaced apart rows of spaced apart bosses. The gaps formed between the spaced apart bosses become closed-bottom wells in which water, snow and particles of dirt scraped from the underside of shoes can accumulate

35 Claims, 15 Drawing Sheets

FLOOR MAT WITH SCRAPING AND WIPING CHARACTERISTICS

CROSS-REFERENCE TO RELATED APPLICATIONS

This is a standard utility application claiming priority from U.S. Provisional Application No. 60/665,005, filed Mar. 24, 2005, the entire specification of which is incorporated herein by reference.

BACKGROUND OF THE INVENTION

1. Technical Field

This invention generally relates to floor mats. More particularly, the invention relates to rubber floor mats that retain dirt and water removed from customers' shoes. Specifically, the invention relates to floor mats that include alternating wiping and scraping strips for removing matter from shoes and closed-bottom wells for retaining the removed matter.

2. Background Information

Floor mats are frequently positioned in entryways so that customers and visitors entering a building can wipe their shoes and thereby reduce the amount of particulate matter, water and snow brought into the building. There are a number of different floor mats presently available. Each of the known mats is designed to serve a slightly different function. So, for example, some mats are made from rubber and have a grid-type construction which allows dirt and water to drop through openings in the mat. These mats allow customers to wipe water and snow off their shoes and the snow and water drops through the openings and therefore is not tracked into the building. Other mats are made with an absorbent uppermost layer that wicks water away from the surface of the mat so that the customer's shoes are effectively dried as they walk across the mat. Yet other mats have a fibrous upper layer which allows the customer to scrape matter from their shoes. Particles and droplets from the shoes drop between the fibers and become trapped therein and this reduces the matter tracked into the building.

While each of the known mats serves their designed function, there is still room in the art for improved floor mats that can be used to both scrap and wipe the soles of shoes and that can store the matter removed therefrom for later disposal.

SUMMARY OF THE INVENTION

The floor mat of the present invention includes alternating zones of different materials that are used to either wipe or scrape the soles of shoes passing over them. Specifically, the mat includes alternating strips of fibrous materials to scrape shoe soles and textured impervious materials to wipe shoe soles. The fibers of the fibrous materials extend above the upper surface of the rubber strip so that the fibers are able to enter between the treads of any shoe sole being scraped thereover. The rubber strip includes a plurality of raised projections and recessed wells. The raised projections assist in wiping materials off the shoe soles and the removed matter accumulates in the recessed wells. Any accumulated materials can be easily removed from the mat by vacuuming the mat or by turning it upside down.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1A:
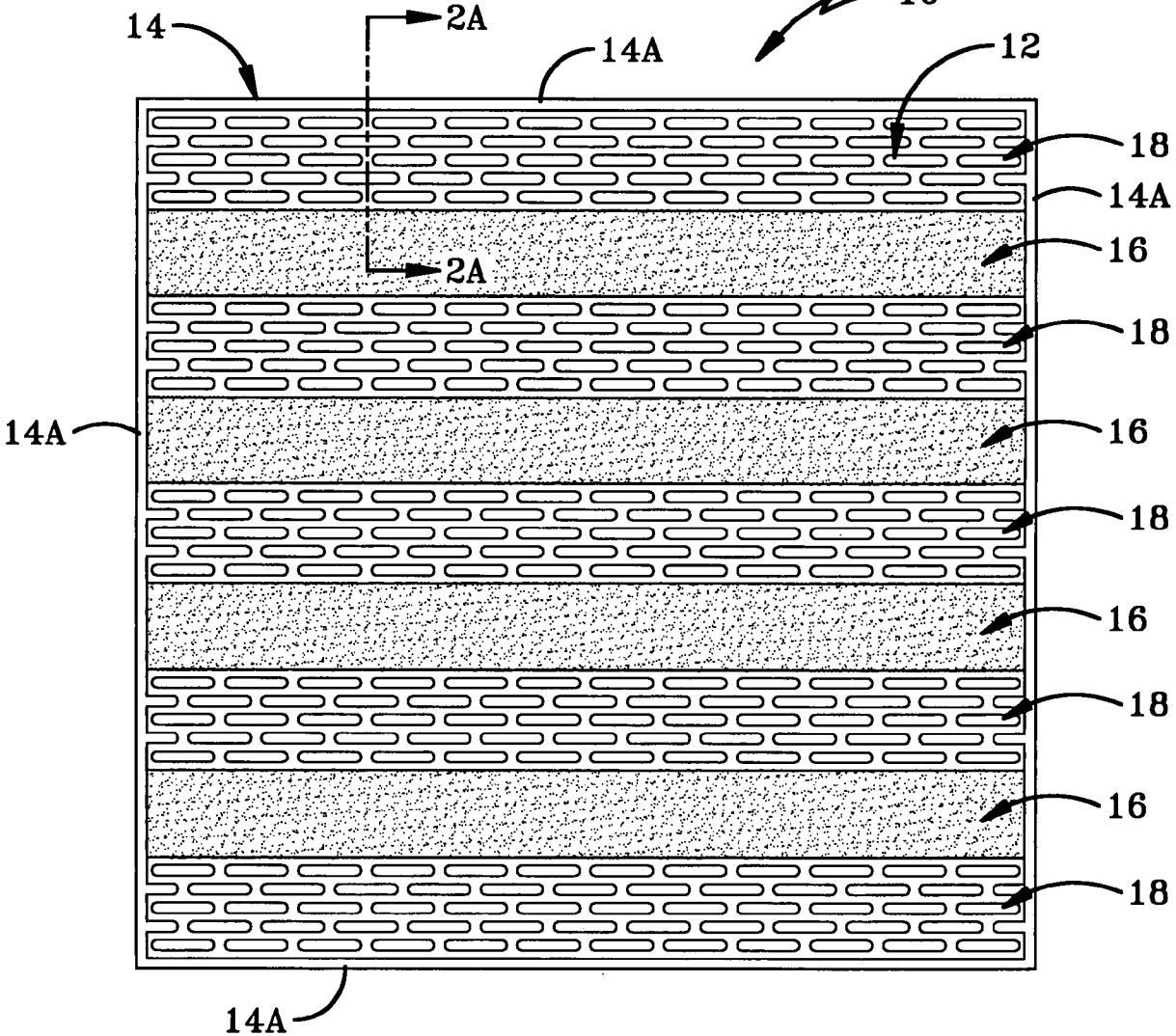
FIG. 1A is a top plan view of a floor mat in accordance with the present invention showing the mat having a narrow border surrounding the alternating fibrous and impervious strips.
Figure 1B:
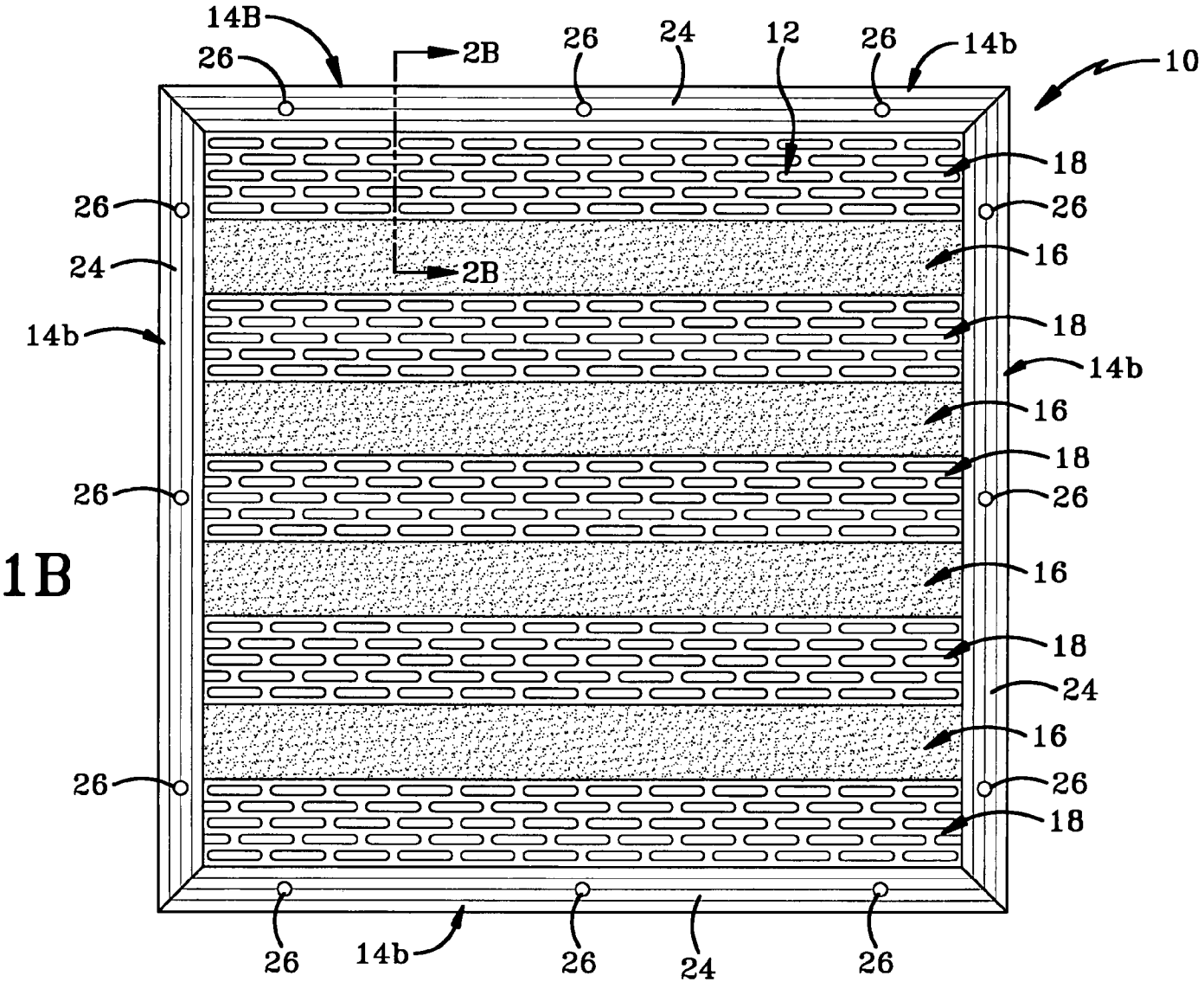
FIG. 1B is a top plan view of a floor mat in accordance with the present invention showing the mat having a frame surrounding the alternating fibrous and impervious strips
Figure 1C:
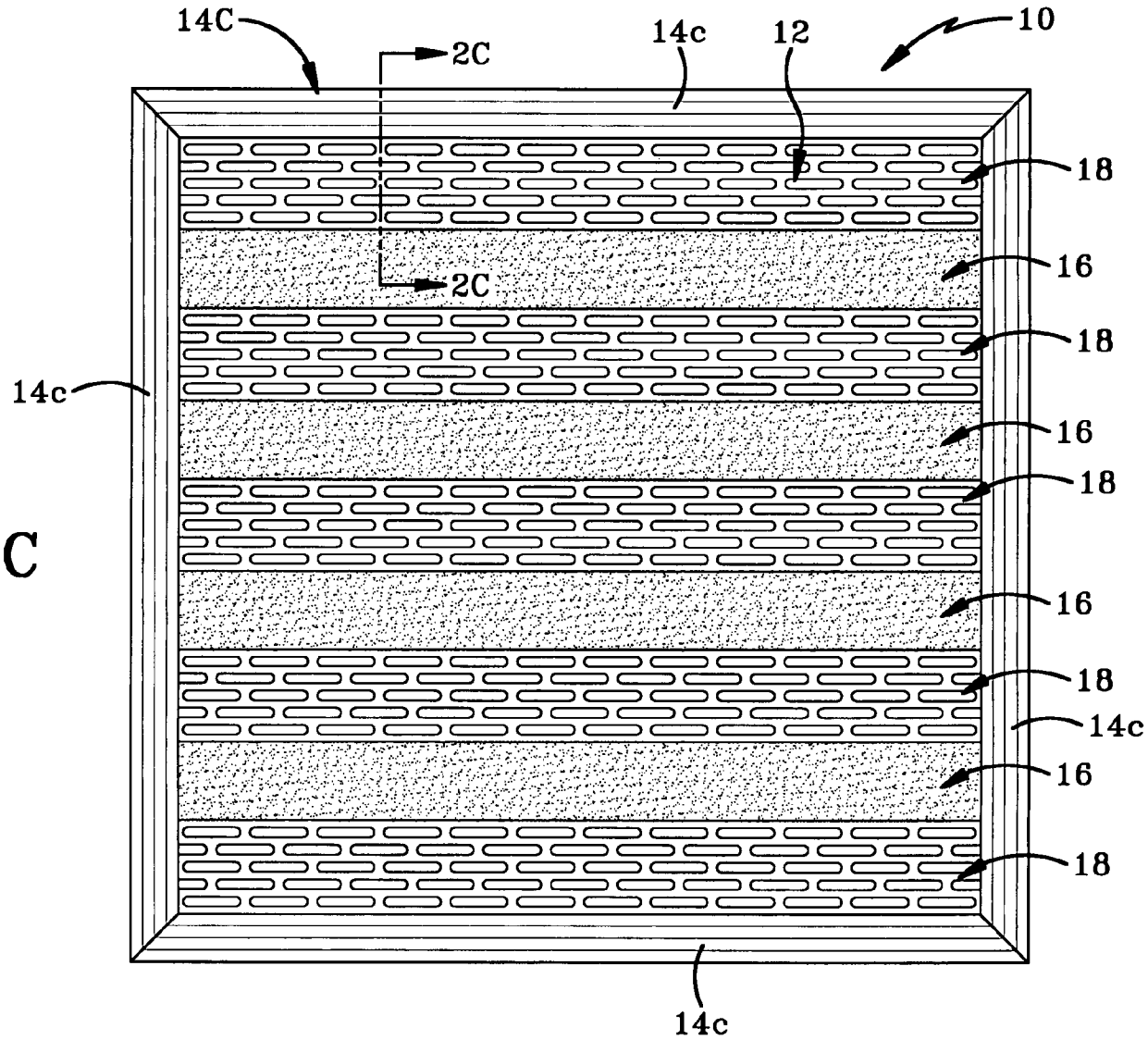
FIG. 1C is a top plan view of a floor mat in accordance with the present invention showing the mat having a sloped border surrounding the alternating fibrous and impervious strips.
Figure 1D:
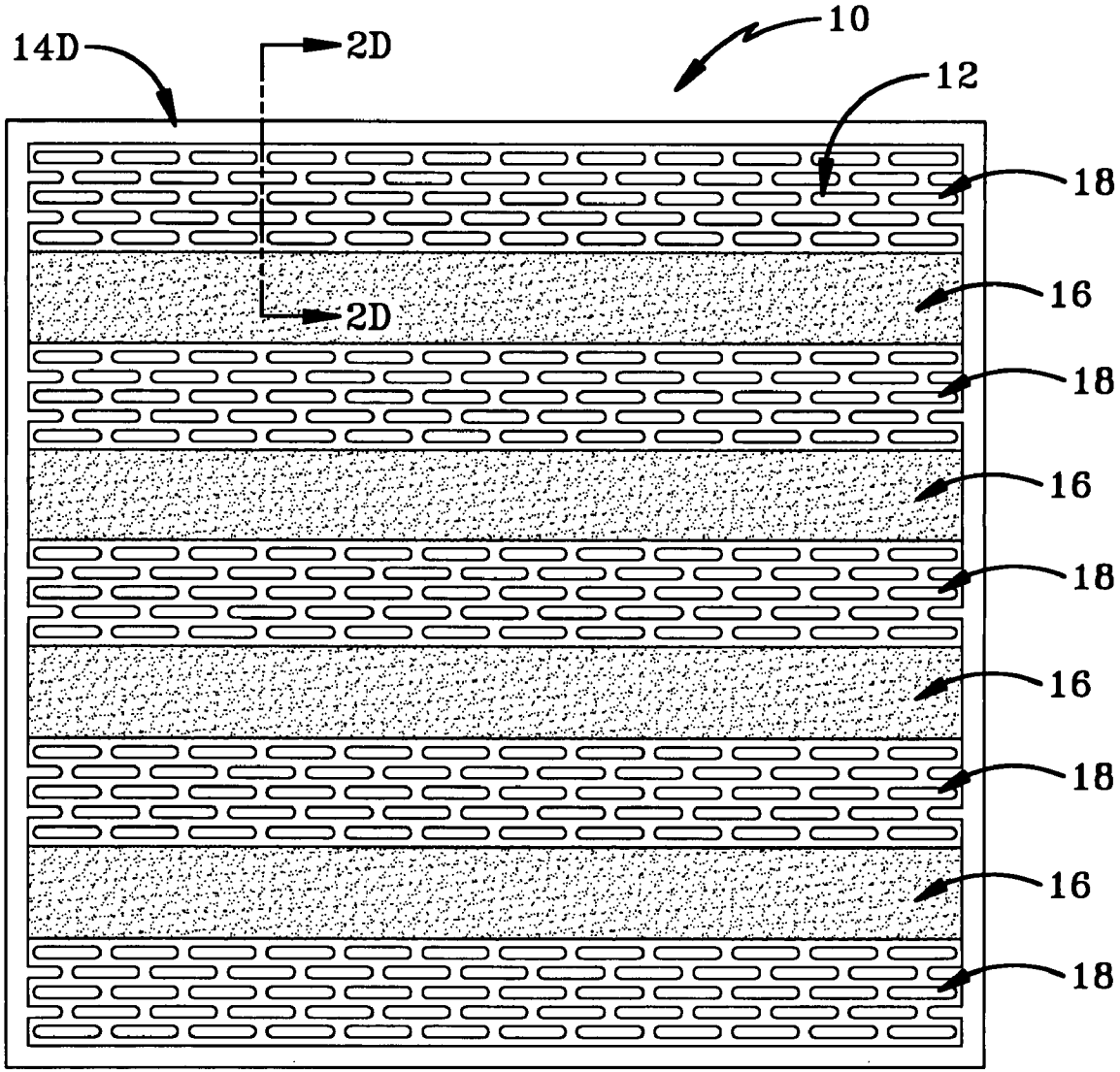
FIG. 1D is a top plan view of a floor mat in accordance with the present invention showing the mat having a wider border surrounding the alternating fibrous and impervious strips.

Referring to FIGS. 1A-2D, there is shown a first embodiment of a floor mat in accordance with the present invention and generally indicated at 10. Mat 10 comprises a generally square base 12 surrounded by a border 14 and having a plurality of fibrous strips 16 disposed at regular spaced intervals across the width of the base 12. Fibrous strips 16 are alternated with impervious strips 18. Fibrous strips 16 and impervious strips 18 preferably are of substantially the same width. Base 12 is molded from rubber, vinyl or any other material that is suitable for entryway floor mats. Base 12 preferably is substantially impervious and is therefore able to prevent water from soaking therethrough. Base 12 is also substantially continuous, having no apertures or openings therein that would allow debris, snow, ice or water to drop through mat 10 and onto floor 20 (FIGS. 2A-2D).

Figure 2A:
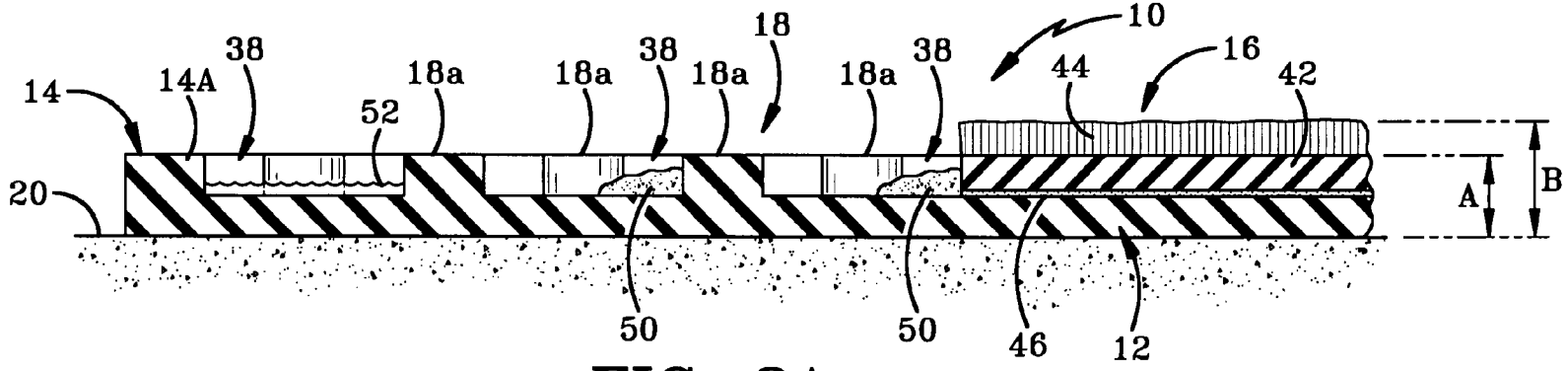
FIG. 2A is a partial cross-sectional front view of the floor mat through line 2A-2A of FIG. 1A.
Figure 2B:
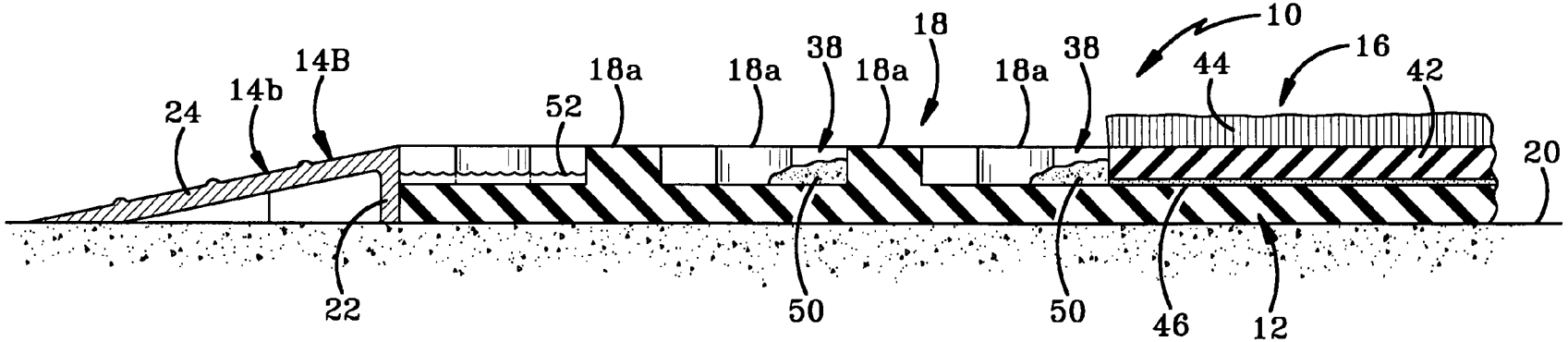
FIG. 2B is a partial cross-sectional front view of the floor mat through line 2B-2B of FIG. 1B.
Figure 2C:
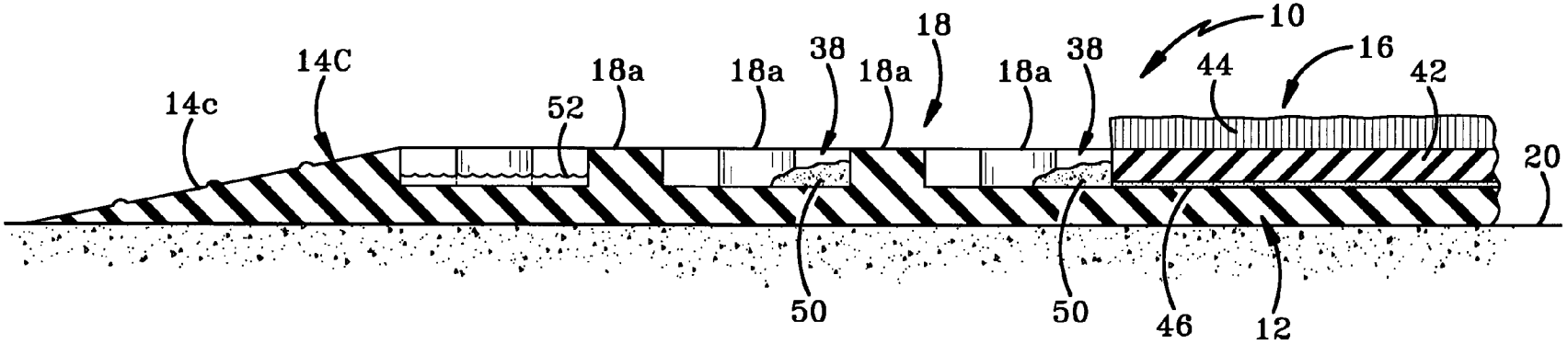
FIG. 2C is a partial cross-sectional front view of the floor mat through line 2C-2C of FIG. 1C.
Figure 2D:
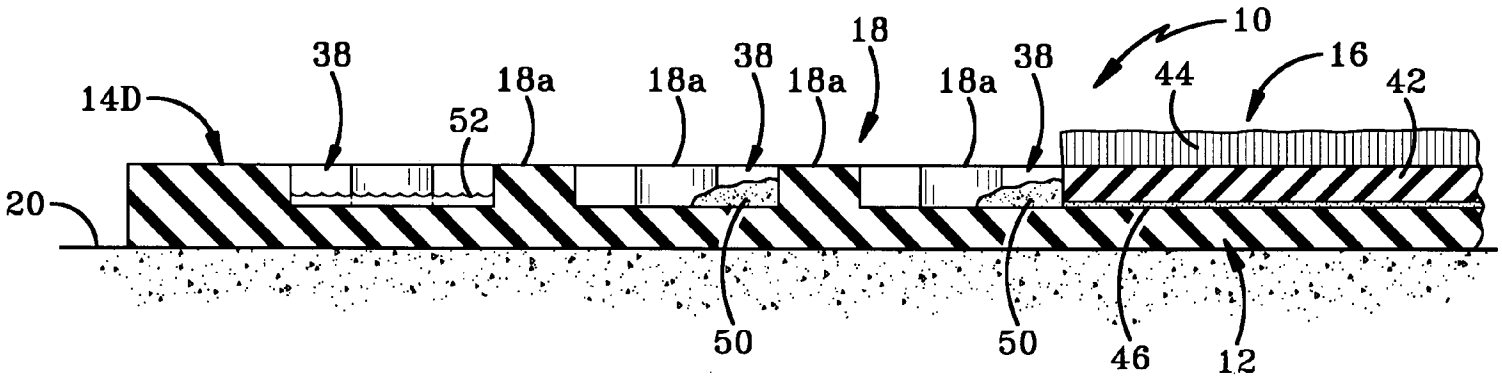
FIG. 2D is a partial cross-sectional front view of the floor mat through line 2D-2D of FIG. 1D.
Figure 3:
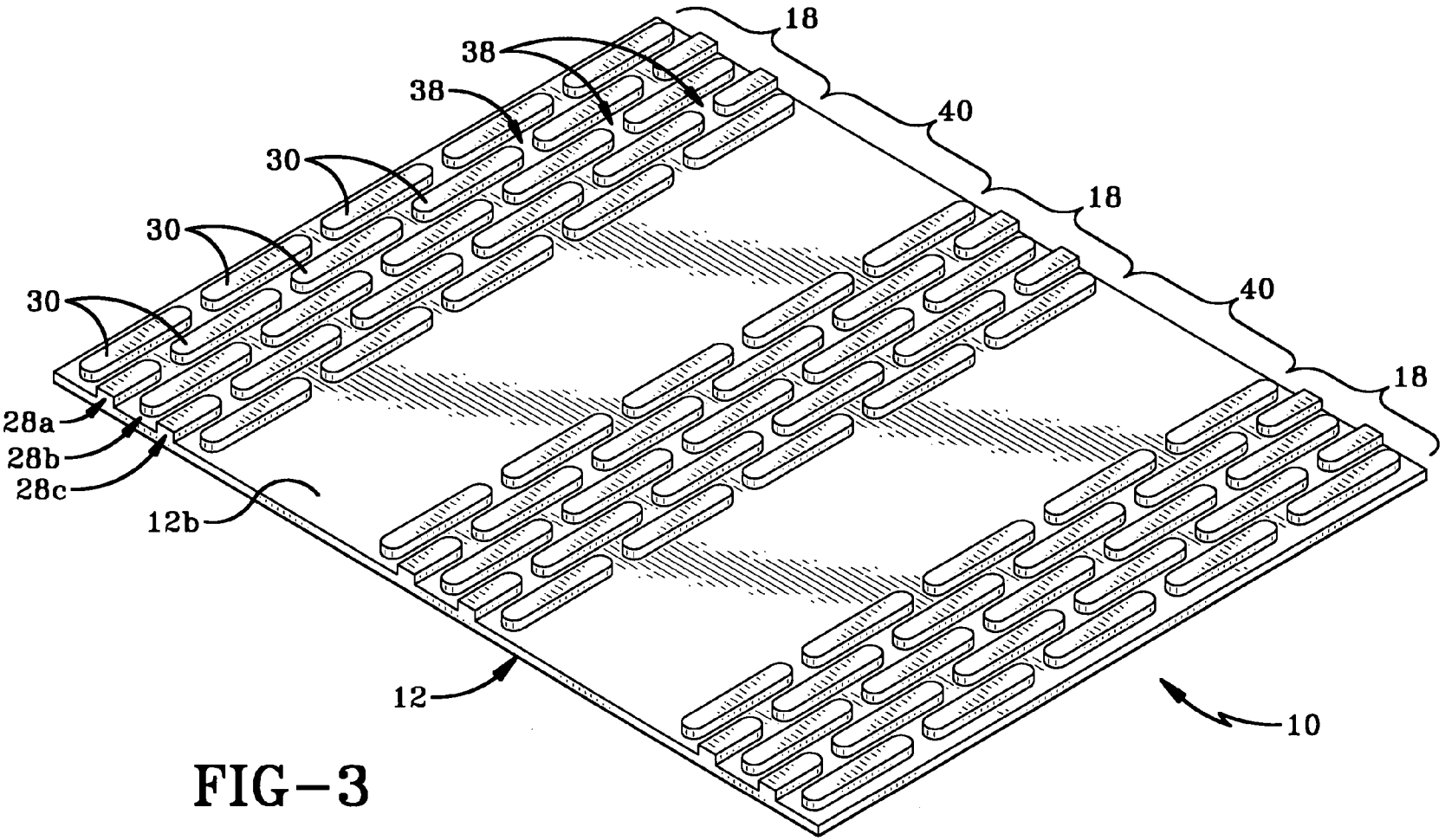
FIG. 3 is a perspective view of the base of the floor mat.

As is shown in FIGS. 1A-2D, border 14 may take several forms. Border 14A preferably comprises a narrow peripheral ridge that is integrally formed with base 12 and surrounds the alternating fibrous strips 16 and impervious strips 18 (FIG. 1A). Border 14A and the uppermost surface 18*a* of rubber strips 18 are of substantially the same height, namely "A", while at least a portion of fibrous strips 16 extend outwardly beyond uppermost surface 18*a*, so that fibrous strips 16 have a height "B". In the preferred embodiment of the invention, height "A" is of the order of 3/16 inch and height B is of the order of between 5/16 and 6/16 inch. Alternatively, as shown in FIG. 1B, border 14B may comprise a frame made from a material such as aluminum. The frame is formed from a plurality of generally triangular, elongated frame members 14*b*. Frame members include a side wall 22 and a sloped top wall 24. Top wall 24 is tapered downwardly away from side wall 22 and provides a smooth transition between floor 20 and mat 10. In this instance, mat 10 may be secured to floor 20 by way of screws 26 (FIG. 1B) inserted through top wall 24 of frame members 14*b* and into floor 20. Alternatively, as shown in FIG. 2C, border 14C may be molded integrally with base 12 and include a sloped top wall 14*c* to make for a smoother transition between floor 20 and mat 10. Border 14D may also comprise a wider strip of material integrally formed with base 12 as is shown in FIGS. 1D and 2D.

Figure 4:
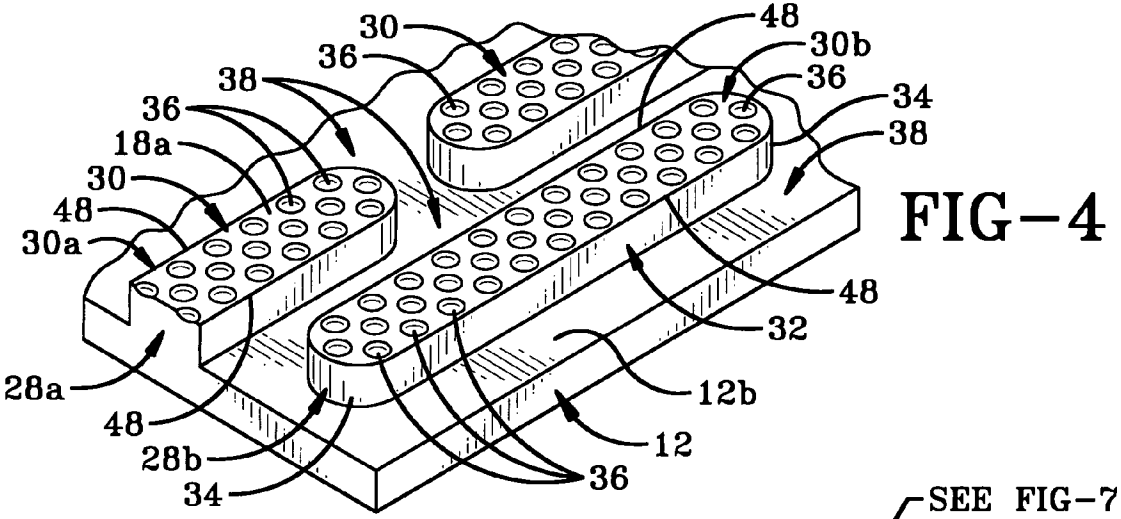
FIG. 4 is an enlarged partial perspective view of the base of the floor mat showing the details of the bosses and the well regions.

Referring to FIGS. 3-8 and as mentioned above, in accordance with one of the specific features of the present invention, mat 10 includes impervious rubber or vinyl strips 18 alternating with fibrous strips 16. The rubber strips 18 are integrally formed with base 12. Each rubber strip 18 comprises a plurality of rows 28 of spaced-apart upstanding bosses 30 separated from each other by substantially flattened sections of the upper surface 12*b* of base 12. Rows, such as rows 28*a*, 28*b* and 28*c* (FIG. 3) lie substantially parallel to each other and extend across the entire length of mat 10. Bosses 30 are integrally formed with base 12 and extend outwardly away from upper surface 12*b* thereof. Each boss 30 is generally rectangular in shape having a peripheral wall 32 (FIG. 4) with rounded ends 34. Bosses 30 preferably are approximately 1½ inches long and ¼ inch wide. The uppermost surface 18*a* of each boss 30 preferably includes a plurality of shallow indentations 36. Furthermore, as is seen in FIG. 4, the rows 28 of bosses 30 are spaced apart from each other and, additionally, the bosses 30 within each row are spaced apart from each other. Furthermore, the bosses 30*a*, 30*b* in adjacent rows 28*a*, 28*b* are staggered relative to each other in a manner similar to how bricks are arranged in a brick wall.

Figure 5:
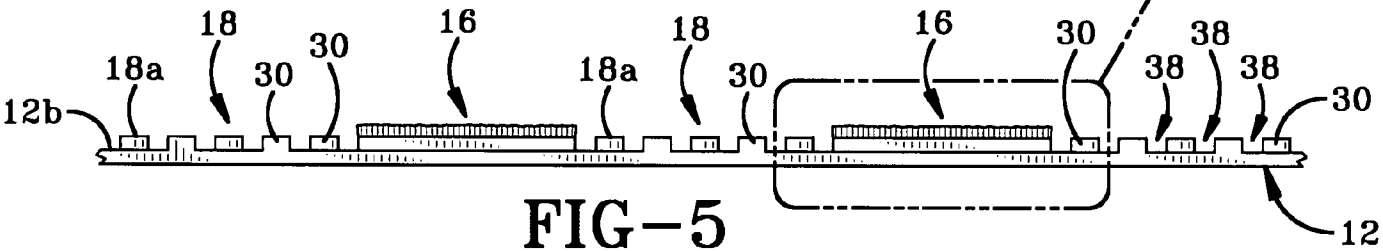
FIG. 5 is a partial front elevational view of the floor mat.
Figure 6:
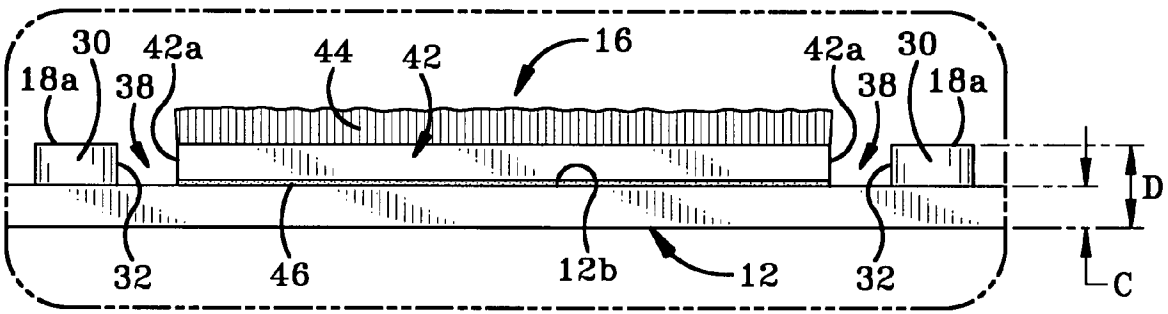
FIG. 6 is an enlargement of the boxed area of the floor mat as referenced in FIG. 5.

In accordance with one of the specific features of the present invention, the spaces formed between the rows 28 and between the bosses 30 within the rows 28 form a network of interlinked well regions 38 (FIGS. 4-6). Well regions 38 have a substantially continuous bottom, being upper wall 12*b* of base 12, and have side walls that are formed by peripheral walls 32 of bosses 30. Each well region 38 has a depth as indicated by "C" in FIG. 6, this depth preferably being about ⅛ inch deep. Well regions 38 are adapted to hold particulate matter, water and snow scraped off from the soles of shoes. Bottom wall 12*b* of well regions 38 preferably is not textured and this allows for easier removal of debris accumulated therein.

Figure 7:
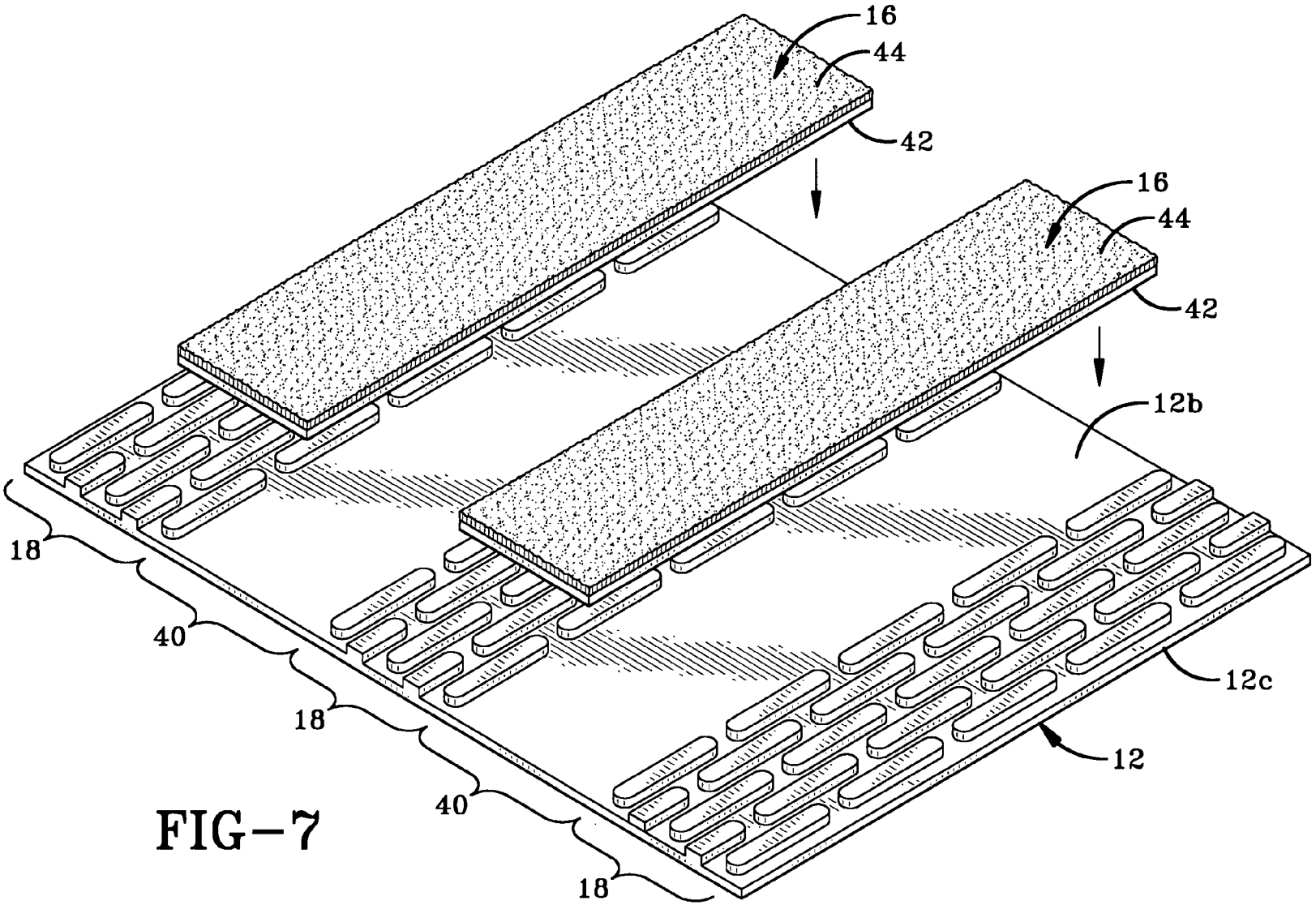
FIG. 7 is a partial perspective view of the floor mat showing the insertion of the fibrous strips into the base of the mat.
Figure 8:
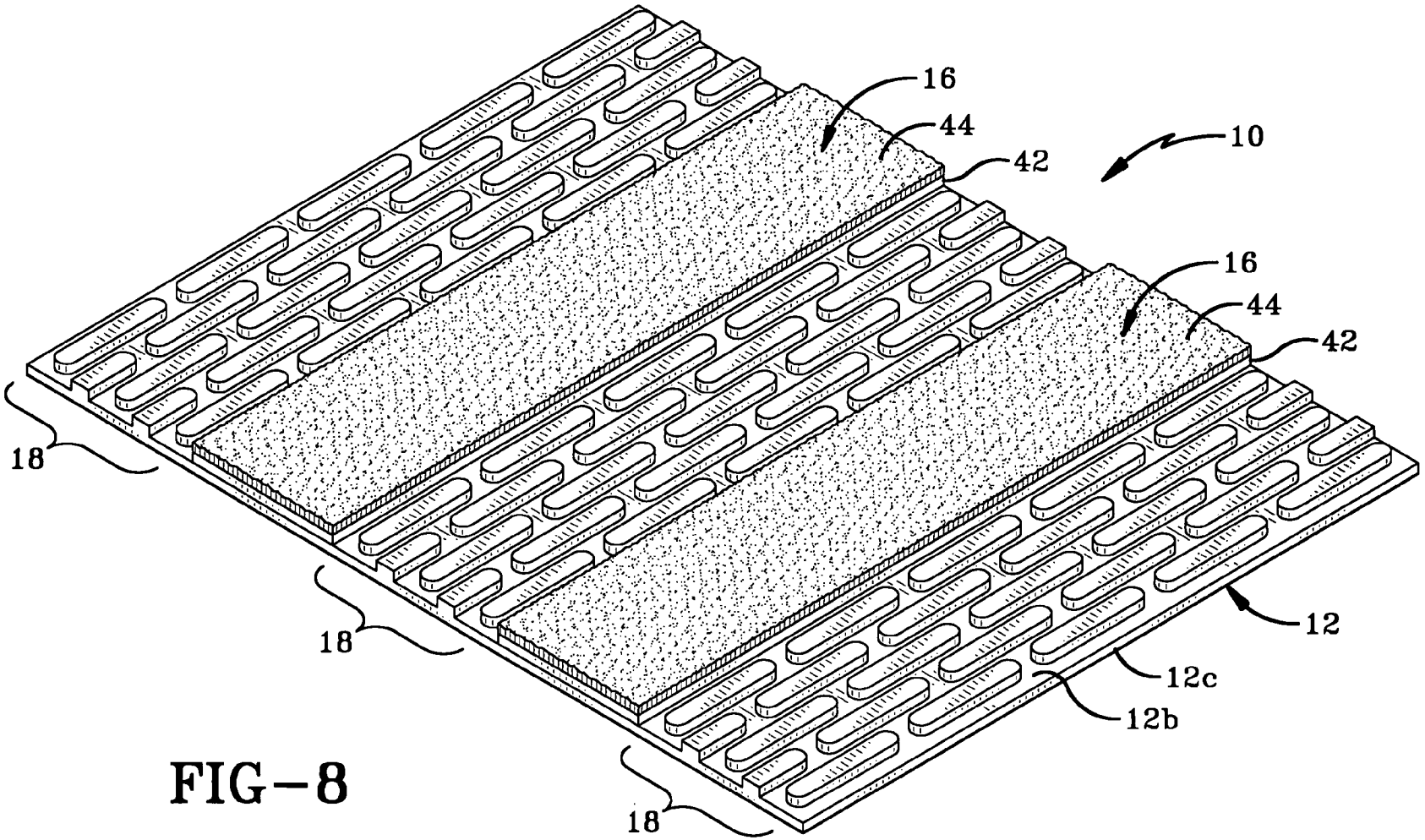
FIG. 8 is a partial perspective view of the floor mat with the fibrous strips inserted into the base between the rubber strips.
Figure 9:
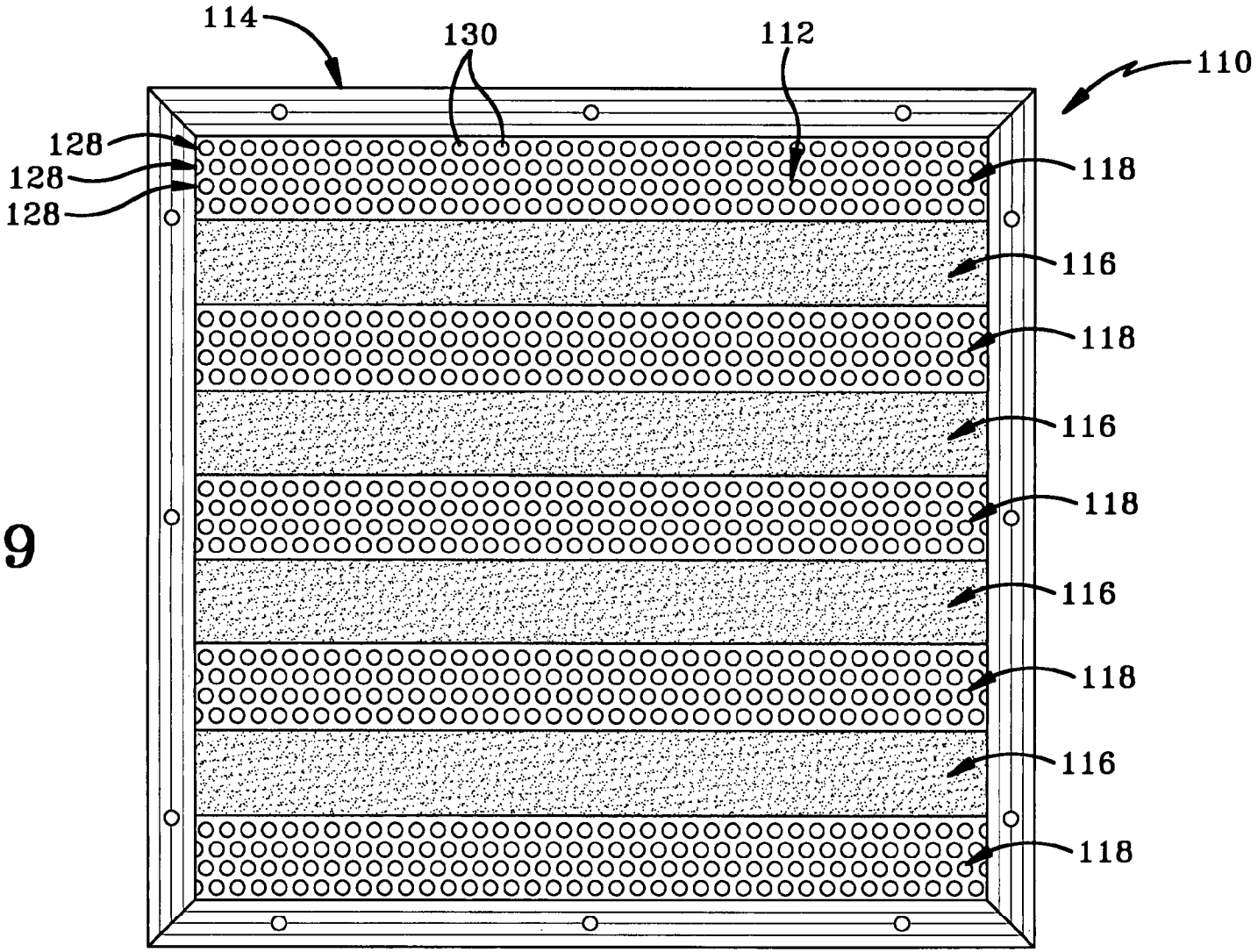
FIG. 9 is a top plan view of a second embodiment of a floor mat in accordance with the present invention.
Figure 10:
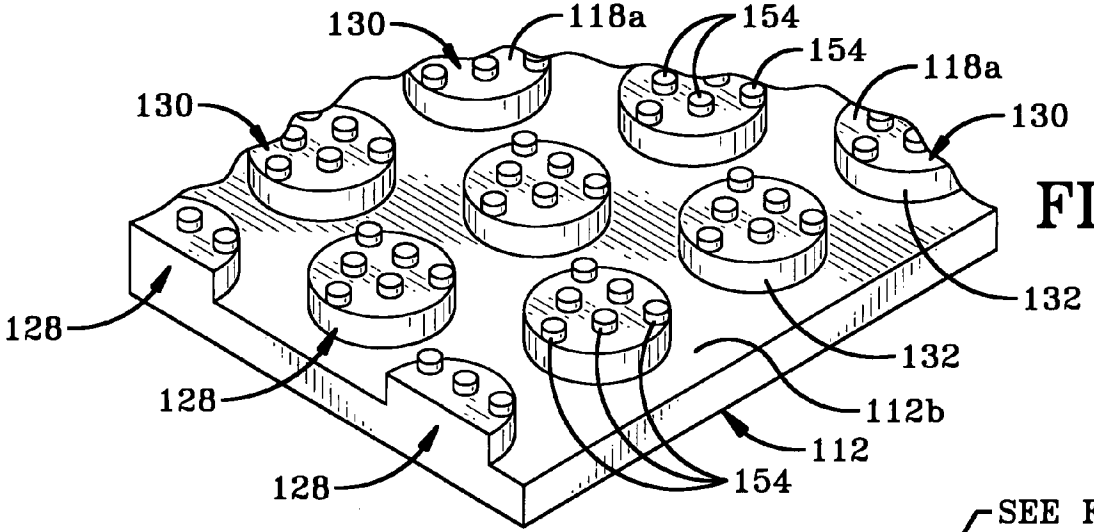
FIG. 10 is an enlarged partial perspective view of the base of the floor mat showing the details features of the bosses and well regions.
Figure 11:
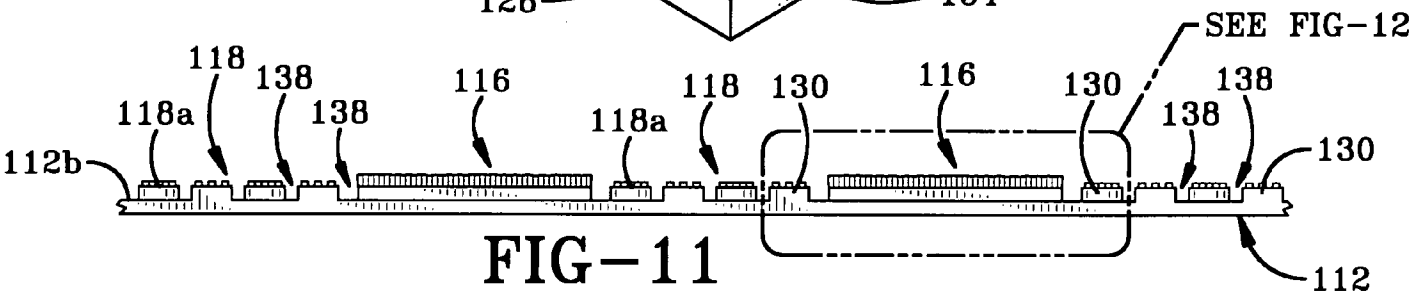
FIG. 11 is a partial front elevational view of the floor mat of FIG. 9.
Figure 12:
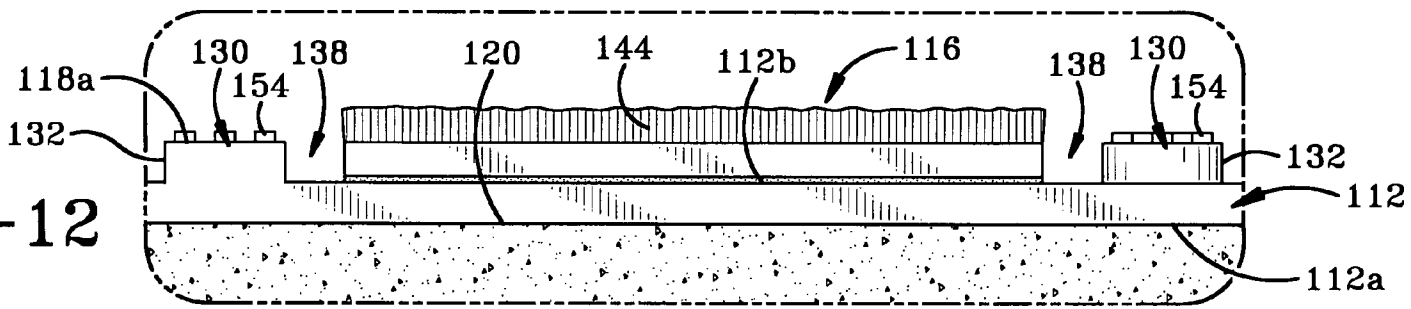
FIG. 12 is an enlargement of the boxed area of the floor mat floor mat as referenced in FIG. 11.
Figure 13:
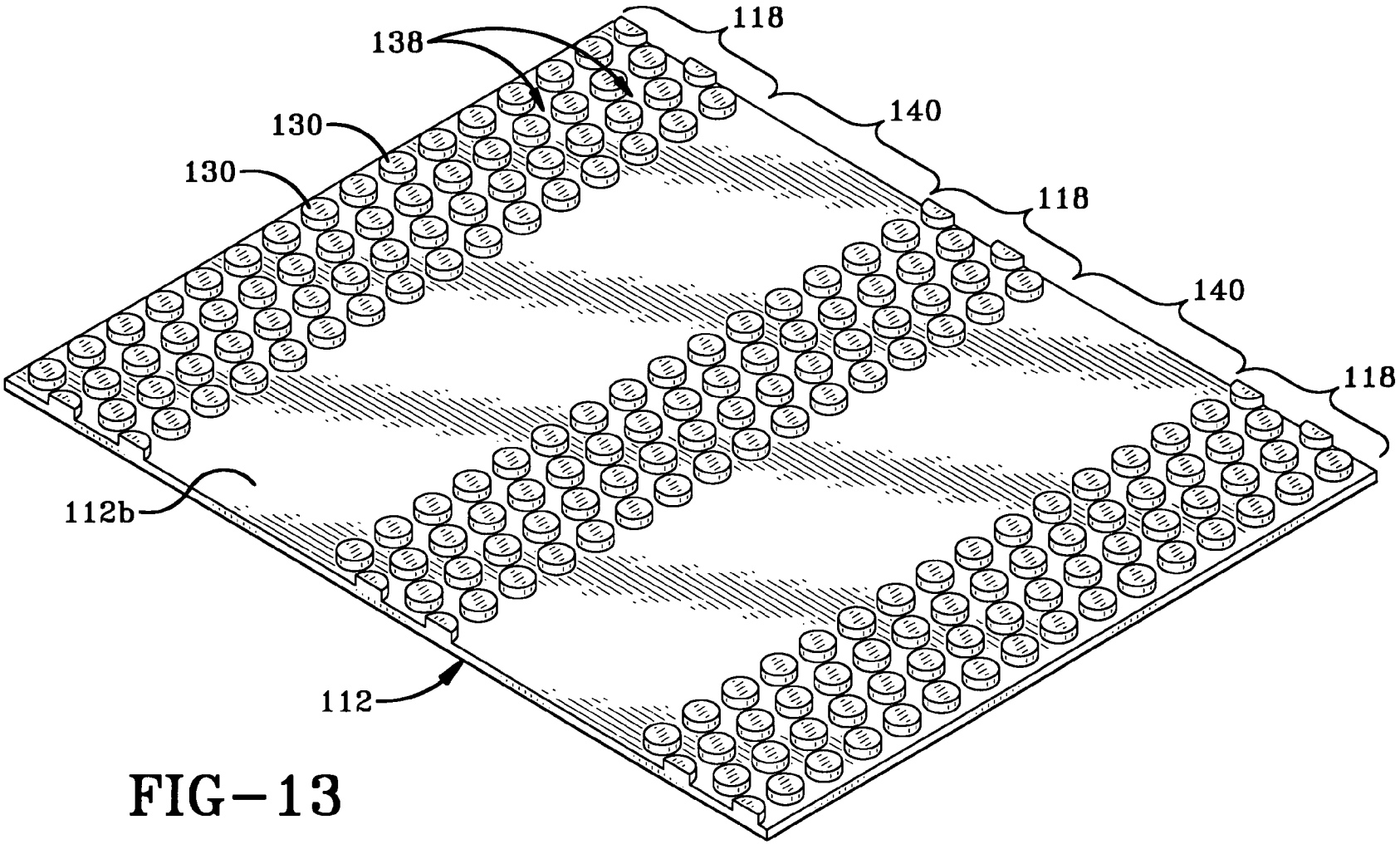
FIG. 13 is a partial perspective view of the base of the floor mat of FIG. 9.
Figure 14:
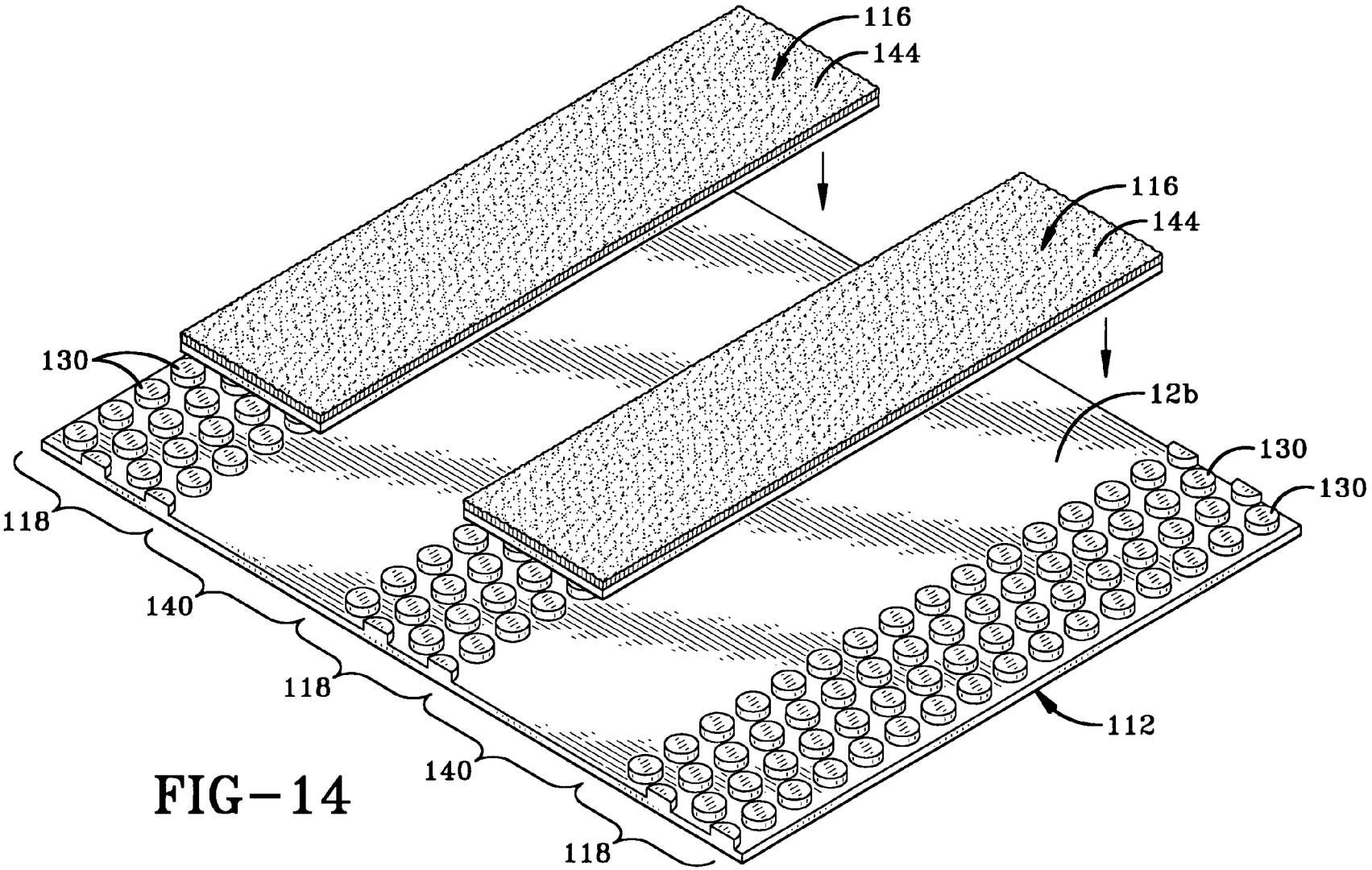
FIG. 14 is a partial perspective view of the base of the floor mat showing the insertion of the fibrous strips.
Figure 15:
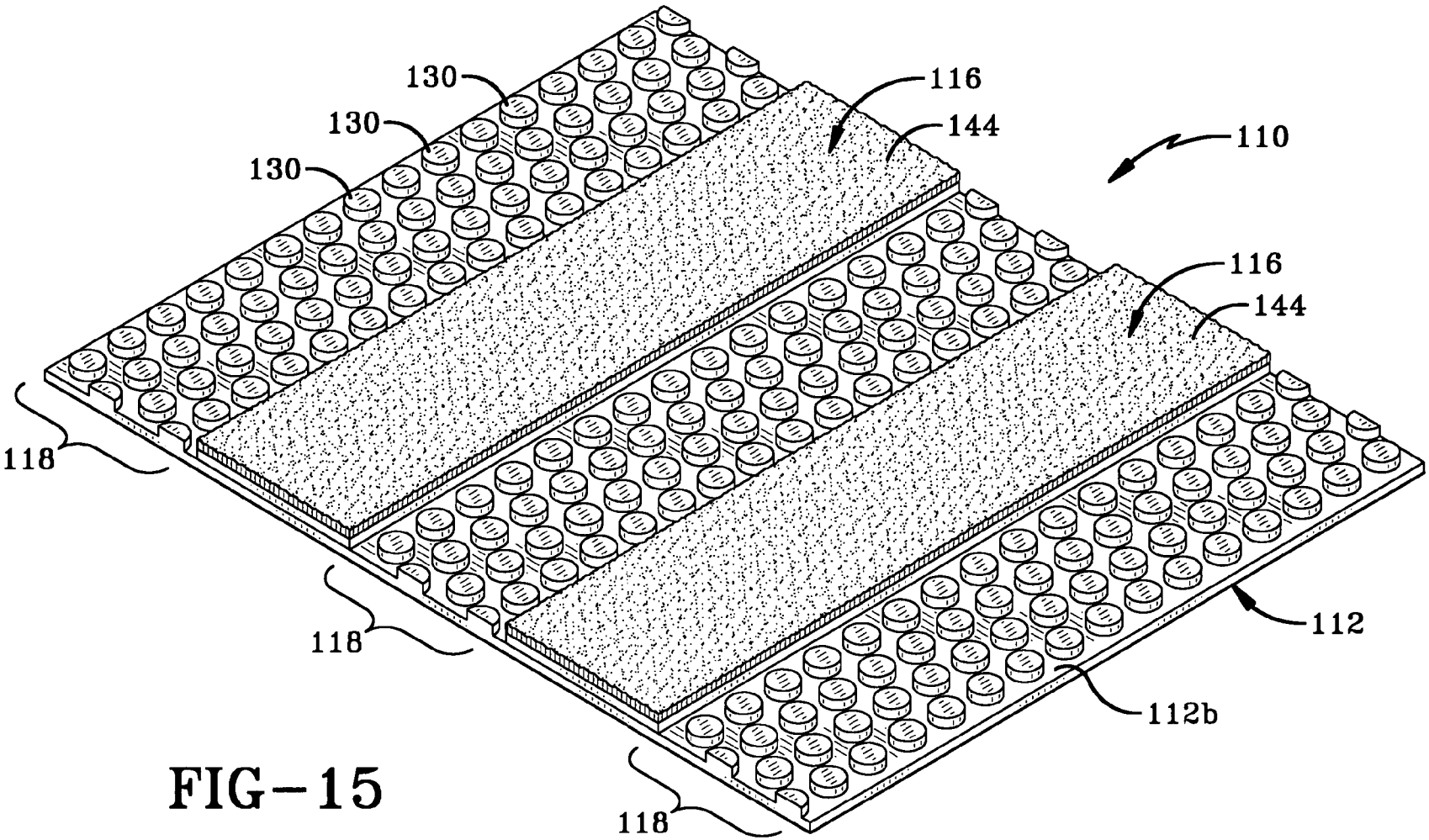
FIG. 15 is a partial perspective view of the floor mat with the fibrous strips alternating with the rubber strips and with the frame not yet installed.

Referring to FIGS. 3-8, a substantially flat channel 40 is formed between each pair of adjacent rubber strips 18. Channels 40 preferably are between 1⅛ and 1½ inches wide. A fibrous strip 16 is secured to upper wall 12*b* of base 12 in each channel 40. Each fibrous strip 16 comprises a rubber layer 42 bonded to a layer 44 of fibrous materials. Fibrous layer 44 is made from any material suitable for cleaning off any matter, such as debris, snow, ice and water from the bottom of shoes as people walk across the mat. During manufacture of mat 10, a layer 46 of adhesive is applied either to the underside of rubber layer 42 or to upper surface 12*b* of base 12 in channel 40. Fibrous strips 16 are then inserted into channels 40 and downward pressure is applied to the same in order to bond fibrous strips 16 to base 12 (FIG. 7). Where a frame is to be applied around mat 10, frame members 14*b* are then attached around the outer edges 12*c* of base 12 in any conventional manner.

As can be seen most clearly from FIGS. 2A & 6, fibrous layer 44 of each fibrous strip 16 extends above the upper surface 18*a* of bosses 30 for a height of between ⅛ inch to ¼ inch, represented by height "D" in FIG. 6. FIG. 6 also shows that well regions 38 preferably are also formed on either side of fibrous strip 16. In this instance, the peripheral walls 32 of bosses 30 and the side walls 42*a* of rubber layer 42 define the side walls of the well region 38.

In use, mat 10 is placed on a floor 20 in the entryway to a building so that when people enter the building, they can wipe their shoes on mat 10. As the soles of shoes move over mat 10, the fibers of fibrous strips 16 scrape matter such as particles of soil and other debris, water, snow and ice from the shoe soles and from any areas between the treads of the shoes. The removal of matter is aided by contact between of the soles of the shoes and the peripheral edges 48 (FIG. 4) of walls 32 of bosses 30. Particles 50 of dirt (FIG. 2A) removed from the shoes accumulate in well regions 38. Furthermore, if the shoes have water droplets or snow thereon, brushing the soles of the shoes across fibrous strips 16 and rubber strips 18 causes the snow and water droplets to fall into well regions 38. Because well regions 38 are closed at the bottom because base is substantially continuous, the water, snow and other particulate matter cannot drop through mat 10 and onto floor 20. Furthermore, it should be noted that well regions 38 are interlinked with each other. Consequently, water 52 (FIG. 2A), which accumulates in well regions 38, tends to flow around bosses 30 and distribute itself across the length and width of mat 10. Mat 10 is therefore able to hold a quantity of water 52 within well regions 38. Furthermore, borders 14A-D prevent water 52 from flowing out of well regions 38 and onto floor 20. Water 52 and particulate matter 50 is therefore retained and contained within well regions 38 in mat 10. When it is desired to clean mat 10, a vacuum can be used to suck the water 52 and particulate matter 50 out of well regions 38. Alternatively, the mat 10 can be lifted off floor 20, carried to a disposal area and inverted to allow the contents of well regions 38 to drop out of mat 10. Mat 10 is then repositioned in the entryway of the building.

A second embodiment of a floor mat in accordance with the present invention is shown in FIGS. 9-15 and generally indicated at 110. Mat 110 has the features of mat 10, including the alternating fibrous strips 116 and rubber strips 118 which are circumscribed by a border, which in this case is a frame 114. It will, of course, be understood that any other type of border may be provided without departing from the spirit of the present invention. Rubber strips 118 include a plurality of rows 128 of bosses 130 which are integrally formed with base 112. Bosses 130 differ from bosses 30 in that they are substantially circular in shape and have a plurality of nodules 154 extending outwardly from their upper surface 118*a*. Each boss 130 is between ⅝ inch and ⅞ inch in diameter and each nodule 154 is approximately 1/32 inches high and 1/16 inch in diameter. It will be understood that nodules of a different size and shape may be formed on upper surfaces 118*a* of bosses 130 without departing from the scope of the invention.

In accordance with the invention, well regions 138 are formed between bosses 130, and are defined by the upper surface 112*b* of base 112 and by the peripheral walls 132 of bosses 130. Because upper surface 112*b* of base 112 is continuous and does not have any openings or apertures through to the lower surface 112*a* (FIG. 12) thereof, well regions 138 are close-bottomed and do not allow any particulate matter or water to escape through mat 110 and onto floor 120. Well regions 138 have a depth substantially equivalent to the height of the peripheral wall 132 of the bosses 130.

As with the first embodiment of mat 10, fibrous strips 116 of mat 110 are adhesively bonded into channels 140 formed in between rubber strips 118 in base 112. As before, the fibrous layer 144 of fibrous strips 116 extends outwardly from base 112 beyond the top surface 118*a* of bosses 130.

In use, both fibrous layer 144 (FIG. 12) of fibrous strips 116 and nodules 154 extending from the top of bosses 130 aid in scraping matter from the underside of people's shoes. Particles of dirt, debris, ice, snow, and water droplets (not shown) accumulate in well regions 138 and cannot pass through mat 110 because of the substantially continuous closed bottom wall thereof, being upper surface 112*b* of base 112. Particulate matter and water are removed from mat 110 in the same manner as mat 10.

It will be understood by those skilled in the art, that bosses 30 may be formed with a plurality of nodules instead if a plurality of indentations 36. Furthermore, bosses 130 may be provided with a plurality of indentations instead of the plurality of nodules 154. It will also be understood that the shape of bosses 30, 130 is by way of example only, any other suitable shape may be utilized without departing from the scope of the present invention. The bosses provided preferably will have rounded peripheral walls because sharp-corners on these walls could catch on the treads of shoe soles and be torn off, leading to premature breakdown of the bosses.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A floor mat for wiping and scraping matter from the underside of peoples' shoes, said floor mat comprising:

a base having an upper surface and a lower surface;

a plurality of spaced apart fibrous regions extending outwardly away from the upper surface of the base;

a plurality of impervious regions interspersed between the fibrous regions; a plurality of spaced apart bosses being provided in each impervious region with each boss having a top surface spaced a distance from the upper surface of the base, and the top surface of each boss includes a plurality of nodules spaced a distance apart from each other, and each nodule extends upwardly and outwardly away from the top surface, and the top surface intermediate the nodules is substantially planar; and wherein each nodule is substantially circular in shape when viewed from above and has a substantially planar uppermost surface spaced a distance vertically above the top surface, and the uppermost surfaces of the nodules are adapted to be contacted by the shoes of persons walking over the mat;

at least one well formed in at least one of the impervious regions adjacent the bosses therein; said well having a bottom wall that is substantially free of apertures, whereby the well is adapted to receive and retain the scraped and wiped matter therein.

2. The floor mat as defined in claim 1, wherein the upper surface of the base is substantially impervious and free of apertures.

3. The floor mat as defined in claim 2, wherein the upper surface of the base forms the bottom wall for the well and the bottom wall is substantially continuous.

4. The floor mat as defined in claim 1, wherein the mat includes a plurality of wells and these wells are formed intermediate and adjacent to the spaced apart bosses of the impervious regions and the wells are in communication with each other.

5. The floor mat as defined in claim 4, wherein the bosses are disposed in a plurality of rows within each of the impervious regions, and adjacent rows of bosses are separated from each other by one of the wells, and each row includes a number of the plurality of bosses.

6. The floor mat as defined in claim 5, wherein the bosses within each row are spaced apart from one another and adjacent bosses are separated from each other by one of the wells.

7. The floor mat as defined in claim 5, wherein the spaces between adjacent rows and the spaces between adjacent bosses within each row define the wells for retaining wiped and scraped matter therein.

8. The floor mat as defined in claim 7, wherein each boss includes a peripheral wall which extends upwardly and outwardly from the upper surface of the base and terminates at the top surface of the boss; and the peripheral walls of the bosses comprise side walls of the wells.

9. The floor mat as defined in claim 8, wherein the peripheral wall of each boss has a height measured from the upper surface of the base to the top surface of the boss; and the wells each have a depth, and the depth of the wells is equal to at least the height of the peripheral walls.

10. The floor mat as defined in claim 8, wherein the top surface of each boss is one of substantially rectangular and substantially circular when viewed from above.

11. The floor mat as defined in claim 8, wherein the peripheral wall of each boss is substantially rounded when viewed from above.

12. The floor mat as defined in claim 1, wherein the fibrous regions include a fibrous layer that extends outwardly above the top surface of each boss.

13. The floor mat as defined in claim 12, wherein each fibrous strips is adhesively bonded into a channel formed between adjacent impervious regions.

14. The floor mat as defined in claim 1, further comprising at least one additional well disposed between an outermost edge of at least one of the impervious regions and a side edge of the fibrous strip disposed adjacent that impervious region, and the one additional well has a bottom wall that is free of apertures.

15. The floor mat as defined in claim 1, wherein the fibrous strips and impervious regions are disposed in substantially alternating parallel lines along a width of the base.

16. The floor mat as defined in claim 1, further comprising a border member disposed around an outermost edge of the base.

17. The floor mat as defined in claim 16, wherein the border member comprises a rubber strip integrally formed with the base.

18. The floor mat as defined in claim 17, wherein the border member comprises an aluminum frame.

19. The floor mat as defined in claim 16, wherein the border has an outermost edge disposed remote from the impervious and fibrous regions and an innermost edge adjacent the impervious and fibrous regions; and wherein the border includes a plurality of spaced apart ridges intermediate the innermost and outermost edges.

20. The floor mat as defined in claim 1, wherein a portion of the upper surface of the base that comprises the bottom wall of the well is substantially smooth.

21. The floor mat as defined in claim 1, wherein the upper surface of the base is substantially free of nodules and indentations.

22. A floor mat for wiping and scraping matter from the underside of peoples' shoes, said floor mat comprising:

a base having an upper surface and a lower surface;

a plurality of spaced apart fibrous regions extending outwardly away from the upper surface of the base;

a plurality of impervious regions interspersed between the fibrous regions; a plurality of spaced apart bosses being provided in each impervious region with each boss having a top surface spaced a distance from the upper surface of the base, and one of a plurality of nodules and a plurality of indentations provided on the top surface of each boss; and wherein the top surface of each boss includes a plurality of indentations spaced a distance apart from each other, and wherein the top surface intermediate the indentations is substantially planar and is adapted to be contacted by the shoes of persons walking over the mat;

at least one well formed in at least one of the impervious regions adjacent the bosses therein; said well having a bottom wall that is substantially free of apertures, whereby the well is adapted to receive and retain the scraped and wiped matter therein.

23. The floor mat as defined in claim 22, wherein the mat includes a plurality of wells and these wells are formed intermediate and adjacent to the spaced apart bosses of the impervious regions and the wells are in communication with each other.

24. The floor mat as defined in claim 23, wherein the bosses are disposed in a plurality of rows within each of the impervious regions, and adjacent rows of bosses are separated from each other by one of the wells, and each row includes a number of the plurality of bosses; and wherein the bosses within each row are spaced apart from one another and adjacent bosses are separated from each other by one of the wells.

25. The floor mat as defined in claim 22, wherein each boss includes a peripheral wall which extends upwardly and outwardly from the upper surface of the base and terminates at the top surface of the boss; and the peripheral walls of the bosses comprise side walls of the wells; and wherein the peripheral wall of each boss has a height measured from the upper surface of the base to the top surface of the boss; and the wells each have a depth, and the depth of the wells is equal to at least the height of the peripheral walls.

26. The floor mat as defined in claim 22, wherein the fibrous regions include a fibrous layer that extends outwardly above the top surface of each boss and each fibrous region is adhesively bonded into a channel formed between adjacent impervious regions; and wherein the fibrous regions and impervious regions are disposed in substantially alternating parallel lines along a width of the base.

27. The floor mat as defined in claim 22, further comprising at least one additional well disposed between an outermost edge of at least one of the impervious regions and a side edge of the fibrous region disposed adjacent that impervious region, and the one additional well has a bottom wall that is free of apertures.

28. The floor mat as defined in claim 22, further comprising a border member disposed around an outermost edge of the base.

29. A floor mat for wiping and scraping matter from the underside of peoples' shoes, said floor mat comprising:

a base having an upper surface and a lower surface;

a plurality of spaced apart fibrous regions extending outwardly away from the upper surface of the base;

a plurality of impervious regions interspersed between the fibrous regions;

a plurality of spaced apart bosses provided in each impervious region, and the bosses are disposed in a plurality of rows within each of the impervious regions and each row includes a number of the plurality of bosses; and the rows of bosses are disposed substantially parallel to each other and extend from a first side of the mat to a second side thereof and the bosses in adjacent rows are staggered relative to each other in a direction disposed at right angles to the rows; and wherein each boss has a top surface spaced a distance from the upper surface of the base and one of a plurality of nodules and a plurality of indentations are provided on the top surface of each boss; and a plurality of wells formed in at least one of the impervious regions intermediate and adjacent to the spaced apart bosses with adjacent rows of bosses being separated from each other by one of the wells and the wells are in communication with each other; and wherein each well has a bottom wall that is substantially free of apertures and the wells are adapted to receive and retain the scraped and wiped matter therein.

30. The floor mat as defined in claim 29, wherein the top surface of each boss includes a plurality of nodules spaced a distance apart from each other, and each nodule extends upwardly and outwardly away from the top surface, and the top surface intermediate the nodules is substantially planar.

31. The floor mat as defined in claim 29, wherein each boss includes a peripheral wall which extends upwardly and outwardly from the upper surface of the base and terminates at the top surface of the boss; and the peripheral walls of the bosses comprise side walls of the wells; and wherein the peripheral wall of each boss has a height measured from the upper surface of the base to the top surface of the boss; and the wells each have a depth, and the depth of the wells is equal to at least the height of the peripheral walls.

32. The floor mat as defined in claim 29, wherein the fibrous regions include a fibrous layer that extends outwardly above the top surface of each boss; and wherein each fibrous region is adhesively bonded into a channel formed between adjacent impervious regions.

33. The floor mat as defined in claim 29, further comprising at least one additional well disposed between an outermost edge of at least one of the impervious regions and a side edge of the fibrous strip disposed adjacent that impervious region, and the one additional well has a bottom wall that is free of apertures.

34. The floor mat as defined in claim 29, wherein the fibrous strips and impervious regions are disposed in substantially alternating parallel lines along a width of the base.

35. The floor mat as defined in claim 29, further comprising a border member disposed around an outermost edge of the base.

* * * * *